US005767623A

United States Patent [19]

Friedman et al.

[11] Patent Number: 5,767,623

[45] Date of Patent: Jun. 16, 1998

[54] INTERCONNECTION BETWEEN AN ACTIVE MATRIX ELECTROLUMINESCENT DISPLAY AND AN ELECTRICAL CABLE

[75] Inventors: Aaron Friedman, Portland; Karen Boris; Iranpour Khormaei, both of Beaverton, all of Oreg.

[73] Assignee: Planar Systems, Inc., Beaverton, Oreg.

[21] Appl. No.: 526,757

[22] Filed: Sep. 11, 1995

[51] Int. Cl.[6] ..... H01J 1/03; H01R 9/09

[52] U.S. Cl. ..... 313/509; 313/500; 174/261; 439/67; 439/71

[58] Field of Search ..... 313/499, 500, 313/506, 509, 583, 422; 345/76, 80; 361/749, 826; 174/261; 439/67, 71, 439, 495; 257/81, 99, 693, 698

[56] References Cited

U.S. PATENT DOCUMENTS

| | | | |
|---|---|---|---|
| 3,579,206 | 5/1971 | Grange | 174/261 |
| 3,643,133 | 2/1972 | Towell | 361/826 |
| 4,733,228 | 3/1988 | Flegal | 340/719 |
| 4,809,078 | 2/1989 | Yabe et al. | 345/76 |
| 5,168,430 | 12/1992 | Nitch et al. | 361/749 |
| 5,183,969 | 2/1993 | Odashima | 361/412 |
| 5,302,966 | 4/1994 | Stewart | 345/76 |
| 5,546,279 | 8/1996 | Aota et al. | 361/749 |
| 5,557,502 | 9/1996 | Banerjec et al. | 174/261 |

OTHER PUBLICATIONS

ACTA Polytechnica Scandinavica, Electrical Engineering Series No. 74, "An Electroluminsescent Display Simulation System and its Application for Developing Grey Scale Driving Methods" by Markku Aberg, Helsinki 1993 (no month).

"Thin-Film Transistor Switching of Thin-Film Electroluminescent Display Elements" by L.K. Kun, F.C. Luo, and J. Murphy, Westinghouse Research and Development Center, Pittsburgh, PA, pp. 236–242, reprinted from Proc. SID, vol. 21, 1980, pp. 85–91 (no month).

"16-Level Gray-Scale Driver Architecture and Full-Color Driving for TFT-LCD" by K. Takahara, T. Yamaguchi, M. Oda, H. Yamaguchi, M. Okabe, Fujitsu Limited, Atsugi, Japan, 1991 IEEE, pp. 115–118 (no month).

"11.3: High-Resolution Active-Matrix Electroluminescent Display" by R. Khormael, S. Thayer, K. Ping, C. King, Planar Systems, Beaverton, OR; G. Dolny, A. Ipri, F-L. Hsueh, R. Stewart, David Sarnoff Research Center, Princeton, NJ; T. Keyser, G. Becker, D. Kagey, Allied Signal Aerospace Corp., Columbia, MD; and M. Spitzer, Kopin Corp., Taunton, MA; SID 94 Digest, p. 137, 3 pages (Jun.).

(List continued on next page.)

*Primary Examiner*—Michael Horabik
*Assistant Examiner*—Michael Day
*Attorney, Agent, or Firm*—Chernoff, Vilhauer, McClung & Stenzel, LLP

[57] ABSTRACT

An active matrix electroluminescent device includes a plurality of layers including at least a transparent electrode layer, a circuit layer including a plurality of first electrical traces, and at least two layers including an electroluminescent layer and a dielectric layer. The at least two layers are disposed between the circuit layer and the transparent electrode layer so as to emit light upon the application of an electric field. The plurality of layers are supported by a support layer. An elongate cable includes a plurality of second electrical traces supported thereon. In a first aspect of the present invention the cable is supported by the support layer and a plurality of electrical conductors electrically interconnecting respective ones of the first traces with the second traces. The electrical signals transmitted from respective ones of the second traces to the first traces permit selection of individual pixels within the device. In a second aspect of the present invention the cable is supported on the circuit layer and the first traces are electrically interconnected with the second traces. The electrical signals transmitted from respective ones of the second traces to the first traces permit operation of the device.

12 Claims, 4 Drawing Sheets

OTHER PUBLICATIONS

"A 6×6 –in 20–lpi Electroluminescent Display Panel" by T.P. Brody, F.C. Luo, Z.P. Szepesi, and D.H. Davies, Westinghouse research Laboratories, Pittsburgh, PA, IEEE Transactions on Electron Devices, vol. Ed–22, No. 9, Sep. 1975, pp. 739–748.

16.4: TFEL Character Module Using a Multilayer Ceramic Substrate, K. Nunomura, Y. Sano, and K. Utsumi, NEC Corporation, Kanagawa, Japan; S. Sakuma, NEC Kansai, ltd., Shig, Japan, SID 87 Digest, pp. 299–302 (no month).

"MOS–EL Integrated Display Device" by K. Oki, Y. Ohkawa, K. Takahara and S. Miura, Fujitsu Laboratories, Ltd. Kobe, Japan, pp. 245–246, reprinted from SID Dig. 1982, pp. 266–267 (no month).

High–Voltage TFT Fabricated in Recrystallized Polycrystalline Silicon by T. Unagami and L. Dogure, IEEE Transactions on Electron Devices, vol. 35, No. 3, Mar. 1988, pp. 314–319.

19.2 Late–News Paper: The Fabrication of TFEL Displays Driven by a–Si TFTs by T. Suzuki, Y. Uno, J. Sakurai, Y. Sato, S. Kyozuka, N. Hiji, T. Ozawa, Fuji Xerox Co., Lt., Kanagawa, Japan, SID 92 Digest, pp. 344–347 (no month).

"37.1: A 31–in.–Diagonal Full–Color Surface–Discharge ac Plasma Display Panel" by S. Kanagu, Y. Kanazawa, T. Shinoda, K. Yoshikawa, T. Nanto, Fukitsu Ltd., Akashi City, Japan, SID 92 Digest, 4 pp. 713–716 (no month).

Evaluation of 64×64 CdSe TFT Addressed ACTFEL Display Demonstrator by J. Vanfleteren, J. Capon, J. De Baets, I. De Rycke, H. De Smet, J. Dourtreloigne, A. Van Calster, P. DeVisschere, Laboratory of Electronics, University of Gent, Belgium; and R. Sallmen, R. Graeffe, Planar International, Espoo, Finland, 1991 IEEE, pp. 134–136 (no month).

4.6: High–Performance Column Driver for Gray–Scale TFEL Displays, S.A. Teiner, H.Y. Tsoi, Supertex, Inc., Sunnyvale, CA, SID 88 Digest, pp. 31–34 (no month).

INTERCONNECTION BETWEEN AN ACTIVE MATRIX ELECTROLUMINESCENT DISPLAY AND AN ELECTRICAL CABLE

BACKGROUND OF THE INVENTION

The present invention relates to an improved interconnection between an active matrix electroluminescent display and an electrical cable.

Referring to FIG. 1, conventionally an active matrix electroluminescent (AMEL) device 12 is constructed of a thin film electroluminescent stack 18 fabricated on a substrate layer 180, a portion of which includes a circuit layer 172 to select individual pixels within the electroluminescent layer 174. The active matrix electroluminescent device 12 is affixed to a rearwardly disposed support layer 10 by an adhesive layer 14. The support layer 10, typically constructed of ceramic, provides structural support for the device 12. The adhesive layer 14 may be any adhesive suitable to maintain the device 12 on the support layer 10.

Referring to FIGS. 1 and 2, a portion 21 of the substrate layer 180 extends beyond an outer edge 23 of the electroluminescent stack 18 to provide a suitable location to electrically interconnect control lines to the circuit layer 172. Electrically conductive traces 22 electrically connected to circuit elements are deposited, or otherwise fabricated, on the circuit layer 172. Circular shaped electrically conductive traces 27 are deposited, or otherwise fabricated, on the support layer 10. Wire bonds 26 electrically interconnect respective pairs of traces 22 and 27. The wire bonds 26 are encapsulated in a nonconductive encapsulant 29 to provide protection for the exposed portion 21 of the circuit layer 172 and wire bonds 26.

A flexible cable 30 has on one side a plurality of parallel spaced-apart conductive traces 31 (see FIG. 2). An anisotropic adhesive 32 electrically interconnects the cable 30 to the traces 27 on the support layer 10. In general an anisotropic adhesive includes electrically conductive material therein to permit electrical conduction between a pair of conductive surfaces, while simultaneously acting as an adhesive. Most of the conductive material in the anisotropic adhesive remain electrically isolated from one another and thereby provides electrical conduction in a transverse direction only with little or no electrical conduction within the plane of the adhesive thereby maintaining electrical isolation between adjacent traces. The anisotropic adhesive 32 electrically connects each trace 27 on the support layer 10 with the respective trace 31 on the cable 30.

The interconnection scheme, as shown in FIGS. 1 and 2, requires several individual connections, namely, the connection between the cable 30 and the traces 27, the traces 27 and the wire bonds 26, and the wire bonds 26 and the traces 22. All these interconnections increase the cost, time to manufacture, and decrease the reliability of transmitting electrical signals to the device 12. An anisotropic adhesive requires a processing step when constructing the device, has a limited shelf life, must be refrigerated prior to use, and is relatively expensive in comparison to standard adhesives, such as epoxy. Furthermore, fabricating traces 27 on the support layer 10 requires a process step increasing the expense of the display. Also, a typical application of an active matrix electroluminescent display is in a head-mounted display, where a display is located in front of each eye of the user. Head-mounted displays frequently have packaging restraints not permitting the supporting layer to extend significantly beyond the electroluminescent stack. However, the support layer 10 extends beyond the electroluminescent layer 18 a significant distance to provide a location to locate traces 27, wire bonds 26, and to adhere the cable 30 thereto.

What is desired, therefore, is an interconnection between an AMEL device and a cable that minimizes the number of interconnections to increase reliability, minimizes the processing required to decrease expense, and minimizes the size of the support layer to reduce expense and conform to packaging restraints.

SUMMARY OF THE PRESENT INVENTION

An active matrix electroluminescent device includes a plurality of layers including at least a transparent electrode layer, a circuit layer including a plurality of first electrical traces, and at least two layers including an electroluminescent layer and a dielectric layer. The at least two layers are disposed between the circuit layer and the transparent electrode layer so as to emit light upon the application of an electric field. The plurality of layers are supported by a support layer. An elongate cable includes a plurality of second electrical traces supported thereon. In a first aspect of the present invention the cable is supported by the support layer and a plurality of electrical conductors electrically interconnects respective ones of the first traces with the second traces. The electrical signals transmitted from respective ones of the second traces to the first traces are used to control an electric field to permit selection of individual pixels within the device.

Preferably the electrical conductors are wire bonds which increases reliability by reducing the number of interconnections to two. Also, this interconnection structure eliminates the necessity of fabricating traces on the support layer and the need for an anisotropic adhesive.

In a second aspect of the present invention the cable is supported on the circuit layer and the first traces are electrically interconnected with the second traces. The electrical signals transmitted from respective ones of the second traces to the first traces permit selection of individual pixel within the device. With the cable supported by the circuit layer, the size of the support layer may be smaller which reduces expense and permits use of the device in a more confined space.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
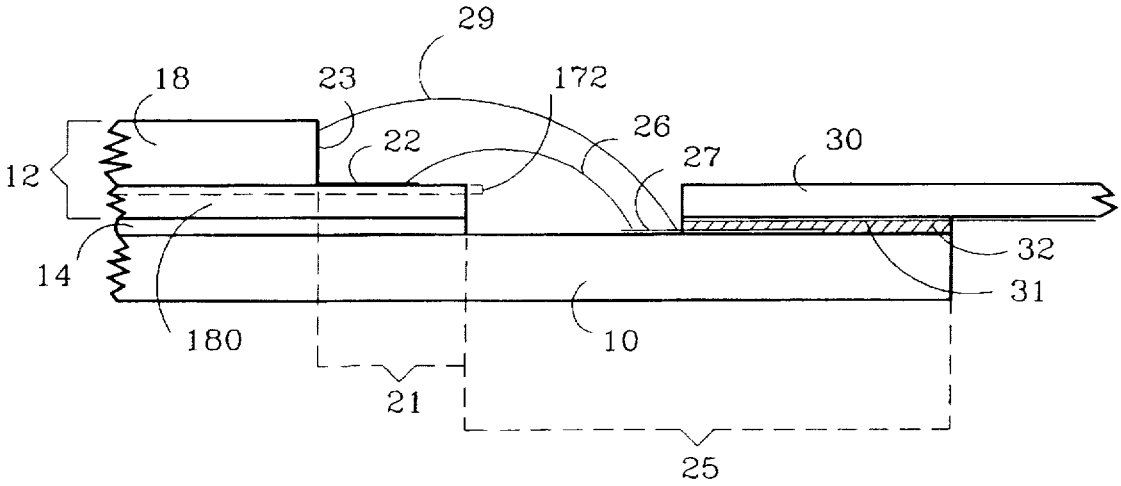
FIG. 1 Prior Art
FIG. 1 is a cross-sectional view of an active matrix electroluminescent device electrically interconnected with a cable, both of which are supported by a support layer.
Figure 2:
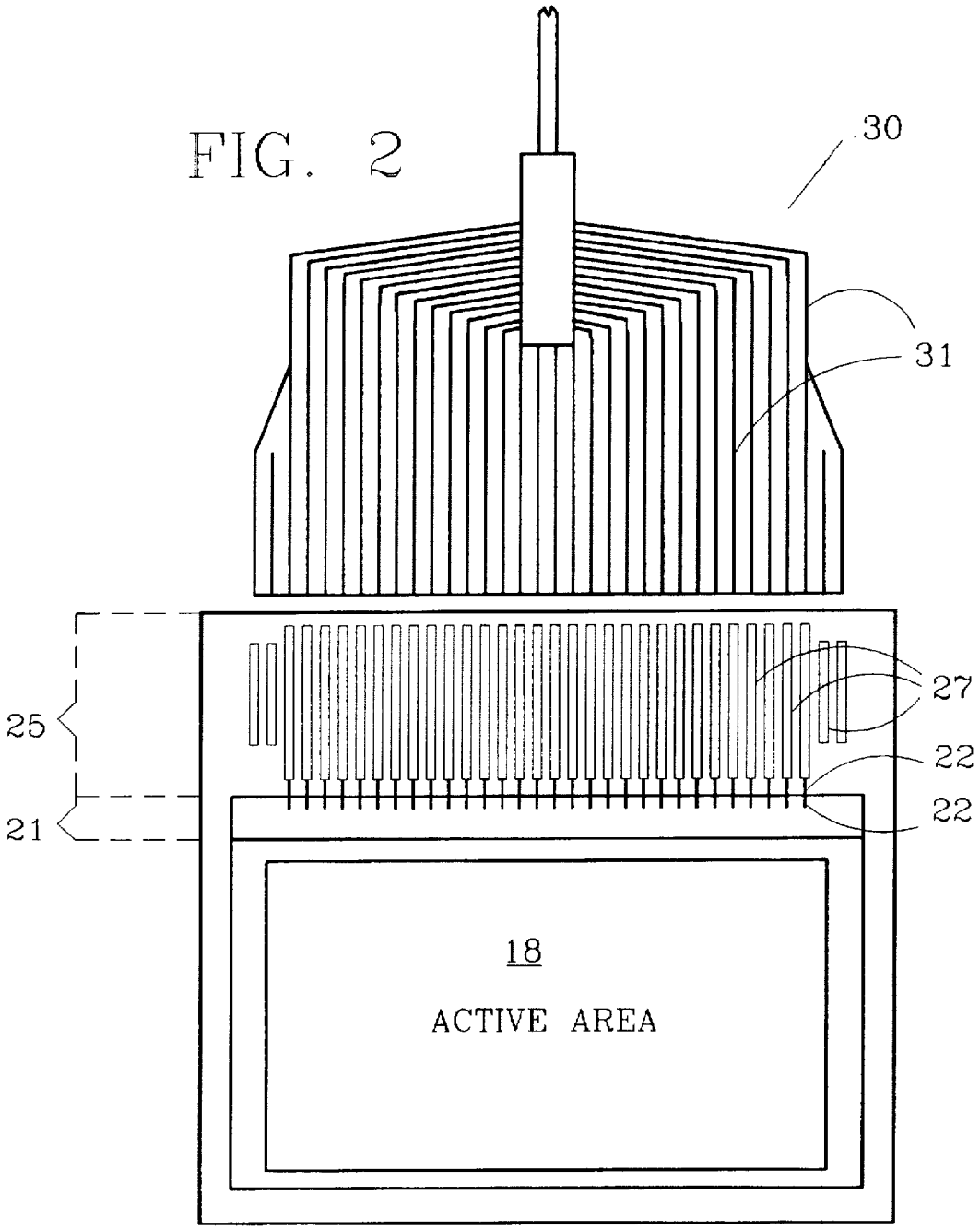
FIG. 2 is a top view of FIG. 1 with the electroluminescent device and cable disconnected from each other.
Figure 3:
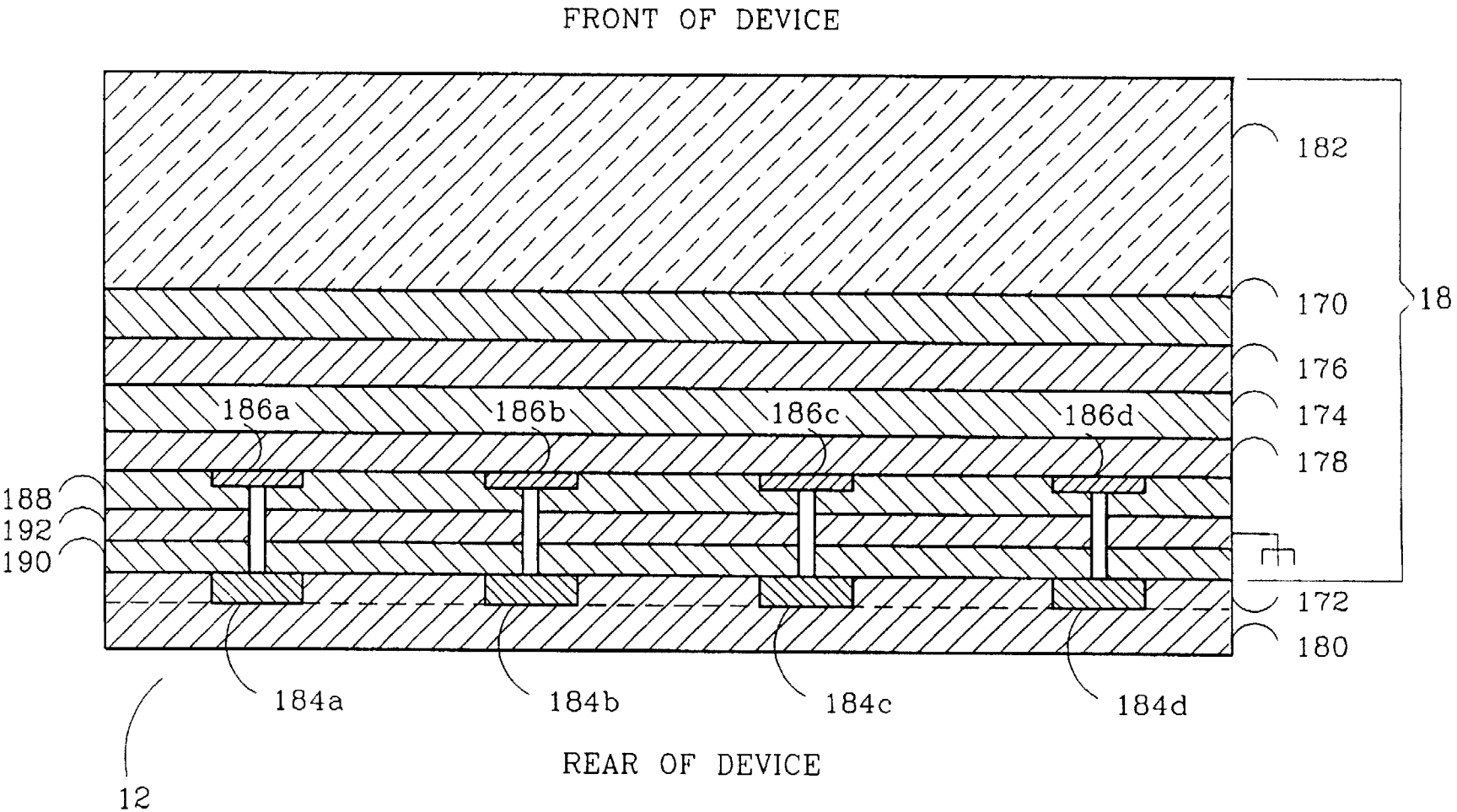
FIG. 3 is a cross-sectional view of an active matrix electroluminescent device.

Referring to FIG. 3, an active matrix electroluminescent (AMEL) device 12 is constructed of a thin-film laminar stack comprising a transparent front electrode 170 carrying an illumination signal, which is typically indium tin oxide deposited on a transparent substrate 182 (glass). A transparent electroluminescent phosphor layer 174 is sandwiched between front and rear dielectric layers 176 and 178, all of which are deposited behind the front electrodes 170. Alternatively, either the front or rear dielectric layer 176 and 178 may be omitted. Pixel electrodes 186*a*, 186*b*, 186*c*, and 186*d* are deposited on the rear dielectric layer 178, typically consisting of a pad of metal or poly-silicon, positioned at each location a pixel is desired within the phosphor layer 174. A first isolation layer 188, second isolation layer 190, and ground plane 192 are deposited on the pixel electrodes 186*a*–186*d* and exposed rear dielectric layer 178. The first and second isolation layers 188 and 190 are preferably constructed out of $SiO_2$ or glass. The first and second isolation layers 188 and 190, and ground plane 192 are preferably constructed with holes, commonly referred to as VIA, for each pixel electrode 186*a*–186*d*, to permit the connection of the pixel electrodes to a circuit layer 172 which is deposited on a substrate layer 180. The substrate layer 180 is typically silicon. The circuit layer 172 permits the individual addressing of each pixel electrode 186*a*–186*d* by its associated circuit element 184*a*–184*d*. As such, an individual pixel within the electroluminescent layer 174 may be selectively illuminated by the circuit layer 172 permitting a sufficient electrical field to be created between the front electrode 170 and the respective pixel electrode 186*a*–186*d*. The circuit layer 172 and circuit elements 184*a*–184*d* therein may be any suitable design, such as those disclosed in U.S. patent application Ser. No. 08/293,144, assigned to the same assignee and incorporated herein by reference.

Wire bonding involves using heat and pressure to bond a wire to an electrical trace or pad. Traditional flexible cables used for thin film electroluminescent displays are not suitable for wire bonding directly to traces on the cables. Such traditional cables are not capable of withstanding the heat and pressure applied during wire bonding directly to traces on the cables. It turns out that the adhesives used to connect the traces on the cable to the plastic support layer of the cable softens when heated during wire bonding resulting in the traces becoming pliable. Pliable traces do not maintain their position under pressure during wire bonding making it difficult to position the wire bonds thereon. Accordingly, traditional wisdom within the thin film electroluminescent display industry is that wire bonding directly to the cable is not feasible, and thus an anisotropic adhesive is used to connect the cable to electrical traces on a support layer, which are in turn electrically connected to the circuit layer by wire bonds.

Figure 4:
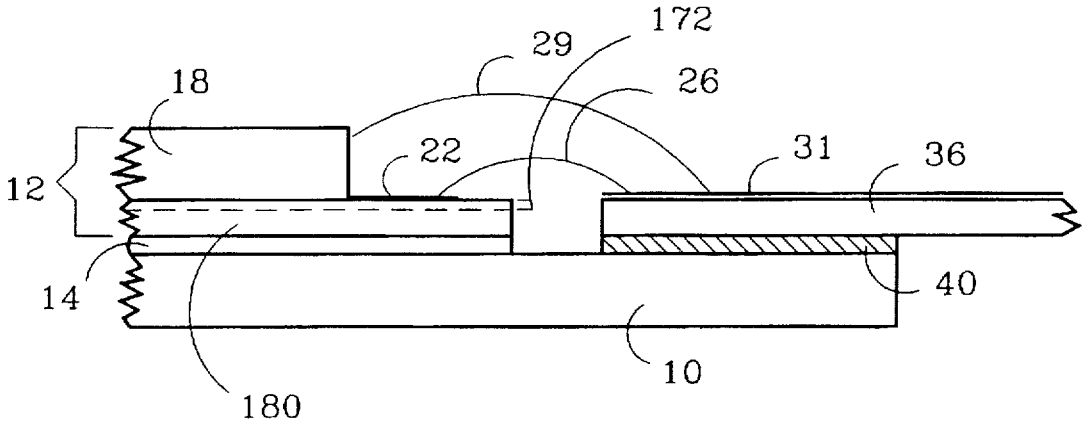
FIG. 4 is a cross-sectional view of a first embodiment of the present invention, wherein an active matrix electroluminescent device is electrically interconnected with a cable, both of which are supported by a support layer.

The present invention overcomes this perceived limitation by providing a cable that includes a more heat resistant adhesive that maintains the traces in their proper position on the plastic support layer under the heat and pressure of wire bonding. Referring to FIG. 4, the cable 36, with its traces 31 (electrical conductors) facing outwardly, is adhered with any suitable adhesive 40 to the support layer 10. The cable 36 with its heat resistant adhesive permits wire bonds 26 (electrically conductive wires) to electrically interconnect the traces 22 on the circuit layer 172 with the traces 31 on the cable 36. The improved cable 36, combined with the modified interconnection structure, reduces the number of connections between the circuit layer 172 and the cable 36, thereby realizing an increase in the reliability of transmitting signals to the display. By eliminating the traces 27 on the support layer 10 there is no need to use an anisotropic adhesive, which reduces the cost of the device and allows the use of an adhesive with a long shelf life that can be stored at room temperature, such as epoxy. Also, by eliminating the traces 27 on the support layer 10 a decrease in processing steps is realized and the size of the support layer 10 may be reduced to a size nearly that of the electroluminescent stack 18, all of which results in a decrease in the overall size of the device, package size, and the cost of the support layer 10. To minimize the size of the silicon substrate 180, it need only be large enough to support a wire bond, and a portion under the electroluminescent stack 18. The wire bonds 26 are encapsulated in a nonconductive encapsulant 29. The traces 22 and 31 may include electrically conductive pads for wire bonding thereto.

The support layer 10 and adhered cable 36 are preferably assembled as one unit. The support layer 10 and cable 36 unit is then adhered to the electroluminescent device 12. Thereafter, the wire bonds 26 are added to electrically interconnecting the cable 36 to the device 12.

Figure 5:
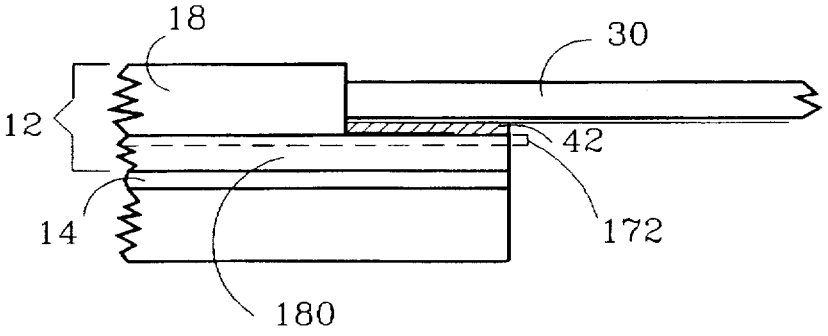
FIG. 5 is a cross-sectional view of a second embodiment of the present invention, wherein an active matrix electroluminescent device is electrically interconnected with a cable, both of which are supported by a support layer.

Referring to FIG. 4, the device 12 still requires wire bonds 26 to electrically interconnect the traces 22 on the circuit layer 172 to the traces 31 on the cable 36. In applications where high signal transmission reliability is a paramount consideration it would be preferable to eliminate the need for wire bonds 26, thereby increasing signal transmission reliability. In addition, the elimination of the wire bonds 26, in favor of a more direct interconnection, would reduce the expense, number of processing steps, complexity, and overall size of the device. To eliminate the wire bonds 26, the traces 22 on the circuit layer 172 should be directly interconnected with the cable 36, thereby minimizing the number of connections. The cable 36 used in FIG. 4 is constructed to withstand the heat and pressure associated with wire bonding. However, such cables are more expensive in comparison to traditional cable that are not designed to withstand such heat and pressure. Referring to FIG. 5, the traces 22 on the circuit layer 172 are directly adhered to a traditional cable 30 using an anisotropic adhesive. However, traditional wisdom is that the heat associated with adhering the cable directly to the silicon substrate 180 will damage the electrical circuitry within the circuit layer 172 and the pressure associated therewith may cause the silicon substrate 180 to fracture. In contrast, the present inventors have discovered that adhering the cable directly to the circuit layer 172 does not necessarily result in damage to the circuit layer 172 and substrate 180. An anisotropic adhesive 42 is preferably used to interconnect the cable 30 to the traces 22, although some other suitable electrical connection may be used.

The spacing of the traces 22 is generally minimized to reduce the size of the substrate 180. Thus, the anisotropic adhesive 42 should have a high density. This interconnecting of the traces 22 and cable 30 permits a reduction in the size of the support layer 10 resulting in a smaller package and decreased cost of the support layer 10. High signal transmission reliability is achieved by electrically interconnecting the cable 30 directly with the circuit layer 172 using an anisotropic adhesive. This also permits a one step process to adhere and electrically interconnect the support layer 10 to the cable 30.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a thin film electroluminescent device including a plurality of layers including at least a transparent electrode layer, a circuit layer, and at least two layers including an electroluminescent layer and a dielectric layer, said at least two layers disposed between said circuit layer and said transparent electrode layer so as to emit light upon the application of an electric field, the improvement comprising:

(a) said plurality of layers supported by a support layer;

(b) said circuit layer including a plurality of electrically conductive first traces;

(c) an elongate flexible cable including a plurality of electrically conductive second traces supported thereon, said cable being supported by said support layer;

(d) a plurality of electrical conductors each having a first end and a second end;

(e) said first end of each of said conductors bonded directly to and electrically interconnected with a respective one of said first traces;

(f) said second end of each of said conductors bonded directly to and electrically interconnected with a respective one of said second traces supported by said elongate cable; and (g) whereby electrical signals transmitted from respective ones of said second traces to said first traces are used to control said electric field.

2. The device of claim 1 wherein a portion of said circuit layer extends beyond said at least two layers, and said first traces are supported on said portion of said circuit layer.

3. The device of claim 1 wherein said support layer extends beyond said plurality of layers, and said cable is adhered to said support layer with said second traces facing away from said support layer.

4. The device of claim 1 wherein a portion of said circuit layer extends beyond said at least two layers, said first traces are supported on said portion of said circuit layer, said support layer extends beyond said plurality of layers, said cable is supported by said support layer and wire bonds electrically interconnect respective ones of said first traces and said second traces.

5. The device of claim 1 wherein said electrical conductors are wire bonds.

6. The device of claim 5 wherein said wire bonds are encapsulated in an electrically non-conductive encapsulant.

7. A thin film electroluminescent device includes a plurality of layers including at least a transparent electrode layer, a circuit layer, and at least two layers including an electroluminescent layer and a dielectric layer, said at least two layers disposed between said circuit layer and said transparent electrode layer so as to emit light upon the application of electric field, the improvement comprising:

(a) said circuit layer fabricated in a silicon substrate layer and including a plurality of electrically conductive first traces on said silicon substrate layer;

(b) an elongate cable including a plurality of electrically conductive second traces supported thereon;

(c) said elongate cable supported by said silicon substrate layer;

(d) said first traces in face-to-face abutment with and electrically interconnected with said second traces; and (e) whereby electrical signals transmitted from respective ones of said second traces to said first traces are used to control said electric field.

8. The device of claim 7 wherein a portion of said circuit layer extends beyond said at least two layers and said first traces are supported on said portion of said circuit layer.

9. The device of claim 8 wherein said cable is supported by said portion of said circuit layer.

10. The device of claim 9 wherein said first traces are electrically interconnected to said second traces by an anisotropic adhesive.

11. The device of claim 7 wherein said plurality of layers are supported by a support layer and a portion of said support layer extends beyond said at least two layers.

12. The device of claim 7 wherein said cable is flexible.

* * * * *